United States Patent [19]

Mays et al.

[11] 4,449,541

[45] May 22, 1984

[54] TOBACCO TREATMENT PROCESS

[75] Inventors: Charles D. Mays, Lewisville; Max A. Wagoner; Daniel G. Williard, both of Winston-Salem, all of N.C.

[73] Assignee: R. J. Reynolds Tobacco Company, Winston-Salem, N.C.

[21] Appl. No.: 269,086

[22] Filed: Jun. 2, 1981

[51] Int. Cl.[3] ..... A24B 3/12

[52] U.S. Cl. ..... 131/302; 131/310

[58] Field of Search ..... 131/296, 300, 302, 303, 131/304, 305, 306, 309, 310

[56] References Cited

U.S. PATENT DOCUMENTS

| | | | |
|---|---|---|---|
| Re. 29,298 | 2/1977 | Banks | 131/144 |
| 3,085,581 | 4/1963 | Rosenberg | 131/144 |
| 3,419,015 | 12/1968 | Wochnowski | 131/138 |
| 3,548,838 | 12/1970 | Key et al. | 131/144 |
| 3,678,939 | 12/1972 | Key et al. | 131/144 |
| 3,742,961 | 7/1973 | Waller | 131/138 |
| 3,800,806 | 4/1974 | Banks | 131/144 |
| 3,817,258 | 6/1974 | Ernow | 131/31 |
| 4,004,594 | 1/1977 | Wochnowski et al. | 131/303 |
| 4,054,145 | 10/1977 | Berndt et al. | 131/139 |
| 4,148,325 | 4/1979 | Solomon et al. | 131/134 |

FOREIGN PATENT DOCUMENTS 1065767 9/1959 Fed. Rep. of Germany .

OTHER PUBLICATIONS

World Tobacco, No. 59, (Jan. 1978), pp. 89–91.

Akehurst, B. C., Tobacco, Longman, (1968), pp. 471–474.

Flavour Industry 4, (No. 11), (Nov.–Dec. 1973), pp. 491–493.

*Primary Examiner*—Vincent Millin

*Attorney, Agent, or Firm*—Herbert J. Bluhm

[57] ABSTRACT

Cut shredded or otherwise comminuted tobacco is treated with a volatile flavoring additive in a continuous process wherein the additive is combined with a polyhydric alcohol carrier and the additive/polyhydric alcohol combination is applied to the tobacco [by gas-atomizing spray nozzle means] under controlled conditions.

27 Claims, 1 Drawing Figure

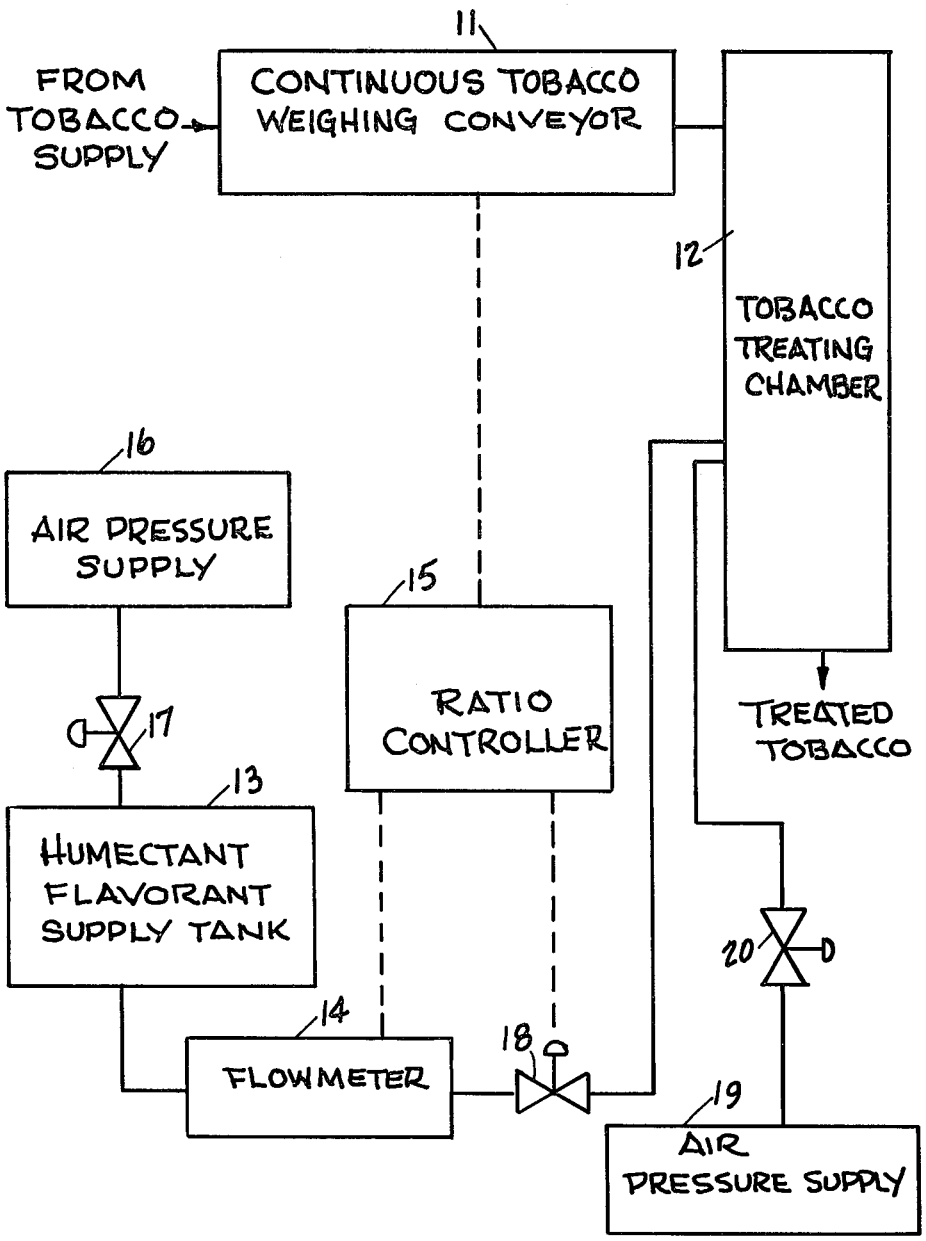
11
FROM TOBACCO SUPPLY
CONTINUOUS TOBACCO WEIGHING CONVEYOR
12
TOBACCO TREATING CHAMBER
16
AIR PRESSURE SUPPLY
15
RATIO CONTROLLER
TREATED TOBACCO
17
13
HUMECTANT FLAVORANT SUPPLY TANK
20
14
FLOWMETER
18
19
AIR PRESSURE SUPPLY

TOBACCO TREATMENT PROCESS

TECHNICAL FIELD

This invention relates to the treatment of tobacco with flavoring and other additives in connection with the manufacture of tobacco products utilizing the treated tobacco.

BACKGROUND ART

The manufacture of tobacco products usually involves treatment of the tobacco being processed with certain additives to enhance the quality and flavor characteristics of the resulting products. In view of the various processing conditions to which the tobacco is subjected, care must be taken so that additives applied to the tobacco are not adversely affected by subsequent processing steps. This is particularly true in the case of flavoring additives which are somewhat volatile because subsequent processing steps involving heat can result in significant losses of the volatile additives from the treated tobacco. Thus, tobacco flavoring additives which are somewhat volatile are generally applied to the tobacco in the form of an alcoholic solution of "top flavors" after the tobacco has already been subjected to the heating and drying conditions which are used during certain processing steps.

In addition to the volatile "top flavor" additives, another category of additives having a relatively low degree of volatility is also customarily applied to tobacco. This category includes materials such as sugars, licorice, cocoa, essential oils, fruit extracts and humectants. These materials are known in the art as "casing" materials and they are applied to the tobacco by dipping or spraying prior to the cutting or shredding operation. While the ingredients used in casing compositions may vary to a considerable degree, the basic components are the sugars and humectants. The sugars serve to import the smoking quality of certain tobaccos such as Burley which are deficient in natural sugars. The humectants impart elasticity to the tobacco and contribute to increased stability of the flavor. It should be noted that water is also used in most casing compositions and can provide improved elasticity or pliability of the tobacco. The elasticity due to water, however, is less permanent than that of humectants because water is removed from the cased tobacco during subsequent processing of the tobacco whereas the less volatile humectants are retained by the tobacco during the heating and drying steps. With regard to the specific humectants used in the treatment of tobacco, glycerine was the original humectant used but other compounds used for this purpose include diethylene glycol, triethylene glycol, propylene glycol, butylene glycol and sorbitol.

Apart from the question of where in the processing sequence, "top flavors" are applied to tobacco, the particular method for applying such additives is of primary concern. The method used must be capable of applying the desired quantities of flavoring material to the tobacco as uniformly as possible. It is not surprising, therefore, that methods and apparatus for applying flavoring materials to tobacco have attracted considerable attention from those skilled in the art. For example, recent improvements in application methods and apparatus are disclosed in U.S. Pat. No. 4,054,145. The complex arrangement described in that patent attests to the difficulties in achieving uniform application of flavoring additives to tobacco.

Perhaps the best known and most widely accepted "top flavor" applied to tobacco is menthol. Menthol is most often applied in the form of a dilute alcoholic solution using a rotating cylinder similar to that shown in U.S. Pat. No. 4,054,145. Alcoholic solutions of menthol have also been applied to tobacco in a pneumatic system as described in U.S. Pat. Nos. 3,548,838 and 3,678,939. In spite of its long history of use, the application of alcoholic solutions of menthol to tobacco is not without its disadvantages. The use of alcohol as a carrier medium for menthol and other flavoring additives is both expensive and hazardous. Since the alcohol is normally not recovered following its removal from the treated tobacco by evaporation, it is necessary to employ venting procedures that will remove most of the alcohol and other volatile materials from the factory area where the tobacco is being treated. Not only do such venting procedures result in losses of menthol and other flavoring additives from the treated tobacco, they also require appropriate steps to prevent the formation of explosive mixtures of alcohol vapors and air. Thus, the alcohol-based flavor application systems incur the cost of the alcohol as well as operation and maintenance of equipment for controlling and removing alcohol vapors released into the factory processing area.

The deficiencies associated with the application of menthol dissolved in alcohol have been recognized by those skilled in the art and have led to the development of methods and apparatus for overcoming these deficiencies. One such method is disclosed in U.S. Pat. No. 3,800,806 (Reissue No. 29,298)which describes a method for applying menthol and other flavorants to tobacco by exposing the tobacco to flavorant vapors under controlled conditions. This method avoids the use of solvents or other carriers and purports to overcome the deficiencies of prior art processes based on the spray application of flavorant solutions. Although the teachings of this patent refer to the variations in flavorant application levels which can occur in prior art processes, no data are provided which would indicate that consistently uniform application levels result from the vaporized flavorant application process disclosed. Indeed, it is stated that the factors affecting deposition of the vaporized flavorant on tobacco include the concentration of flavorant vapor in the process stream, the contact time of flavorant vapor with tobacco, temperature of the air stream in the pneumatic conduit, velocity of air in the conduit, tobacco feed rate and tobacco temperature. In order to maintain the desired concentration of flavorant vapor in the process stream, it is necessary to withdraw samples of the pneumatic stream flowing through the conduit for analysis so that additional flavorant can be injected into the process stream. It is apparent that the number of factors that must be precisely controlled in the process increase processing costs without providing any guarantee that variation in flavorant application levels will not occur due to inadequate control over one or more process parameters. Thus, the method disclosed in U.S. Pat. No. 3,800,806 is not entirely satisfactory.

Another attempt to solve the problem of applying uniform quantities of flavorants such as menthol to tobacco is described in U.S. Pat. No. 3,817,258 and the corresponding U.K. patent specification No. 1,357,057. This patent discloses a method and apparatus for applying a flavorant solution to a shredded tobacco stream just before the tobacco is made into cigarettes. The teachings indicate that menthol dissolved in alcohol is sprayed, preferably in aerosol form, onto a moving layer of tobacco just before the tobacco layer is deposited onto a moving web of cigarette paper on a cigarette making machine. Although the disclosed invention has certain attractive features, it has proven to be somewhat unsatisfactory when used with present-day high speed cigarette making machines. Some of the invention's drawbacks are discussed in U.K. patent application No. 2,030,894 published in April 1980. The net result is that a completely satisfactory solution to the problem of applying uniform levels of flavorants to tobacco in an economical manner continues to elude those skilled in the art.

In this review of background art, it should be noted that a number of references teach the use of solvents other than alcohol for applying menthol and other flavorants to tobacco. For example, U.S. Pat. No. 3,085,581 discloses a process for spraying cigar tobacco with a composition containing menthol, butylene glycol and water. U.S. Pat. No. 4,128,101 (Example IV) discloses the treatment of tobacco with a 5 percent by weight solution of 3-ethoxy-4-hydroxy-benzaldehyde 2,2-dimethylpropanediol acetal in propylene glycol although it is evident from the teachings that solvent systems based on ethyl alcohol are preferred. In German Pat. No. 1,065,767, tobacco is treated with solutions of menthol and certain menthol esters in solvents such as diethylene glycol, 1,3-butylene glycol and isopropyl alcohol. Other references could be cited which teach the use of glycols as solvents for flavoring additives but such teachings are usually found in connection with casing compositions which are based largely on flavorants of low volatility. In spite of the numerous teachings relating to the addition of flavorant additives, there is an apparent lack of recognition among those skilled in the art as to how relatively volatile flavor additives may be applied to tobacco without the use of costly volatile solvents and/or apparatus for incorporating volatile flavorants into tobacco products.

BRIEF SUMMARY OF THE INVENTION

This invention provides a method for incorporating a volatile flavoring additive into cut, shredded or otherwise comminuted tobacco in connection with the manufacture of tobacco products.

It is a principal object of this invention to provide a method for applying a volatile flavoring additive to cut, shredded or otherwise comminuted tobacco which avoids the use of solvents with low boiling points as a carrier medium for the flavoring additive.

It is a further object of this invention to provide a method for continuously applying uniform amounts of a flavoring additive and a humectant material to a moving stream of cut or shredded tobacco.

Further objects of this invention include a reduction in evaporative losses of a volatile flavoring additive from treated tobacco and an overall reduction in the release of potential air pollutants from the treatment of tobacco with a volatile flavoring additive when compared with prior art methods based on flavorant carrier solvents having low boiling points.

Other objects and advantages of the invention will be apparent from the detailed description which follows.

DETAILED DESCRIPTION OF THE INVENTION

In the conventional processing of cured tobacco destined for use in consumer products such as cigarettes and pipe smoking tobacco, tobacco strips (i.e., pieces of tobacco leaf lamina having stems and midribs removed therefrom) are treated with casing materials before further processing. The casing materials are essentially aqueous solutions of sugars and humectants which are applied to the cased strips prior to or in conjunction with a heating treatment to seal the casing in the leaf and to carmelize the added sugars. The treated tobacco strips are cut or shredded while still moist to give particle sizes of desired dimensions and the cut or shredded tobacco is again heated to reduce moisture levels. The dried and cooled cut tobacco is normally treated with an alcoholic solution of relatively volatile top flavors to impart desired flavors notes and aroma to the tobacco. The alcohol is allowed to evaporate from the treated tobacco before the tobacco is incorporated into smoking tobacco products.

This invention is based on the discovery that the quantities of humectants used in the casing materials applied to tobacco strips can be reduced substantially without apparent adverse effects on the tobacco during the subsequent processing steps and that the quantities of humectants withheld from the casing materials can instead be used as a vehicle or carrier for the top flavors applied to the cut or shredded tobacco. The net result is that the final humectant levels applied to the tobacco are essentially unchanged while the alcohol previously used for applying the volatile flavoring additives is no longer needed. Not only is there a substantial economic benefit realized by eliminating the cost of the alcohol carrier for the top flavors but a source of air pollution (i.e., the evaporating alcohol) is also eliminated.

The humectants which may be used in carrying out the process of this invention are those which are normally liquid at the processing temperatures employed. Those humectants which are preferred carriers include polyhydric alcohols such as propylene glycol, dipropylene glycol, trimethylene glycol, diethyleneglycol, triethyleneglycol, glycerol, α-methylglycerol and 1,2-, 1,3-, 1,4- and 2,3-butanediols. Propylene glycol and glycerol are particularly preferred as humectant/solvent agents since they are already widely used as tobacco humectants.

Humectants which are normally in the solid state at ambient temperatures (e.g., sorbitol) may also be used with this invention provided that the volatility of the flavoring additives incorporated therein and the operating temperatures employed do not lead to unacceptable losses of flavoring additives due to evaporation. In order to avoid excessively high operating temperatures, it is desirable to include one or more additional humectants and/or water in the carrier medium with the solid humectant. This will ensure that the medium is maintained in the liquid state at operating temperatures that are somewhat lower than would otherwise be the case.

A variety of flavoring additives may be applied to the tobacco by using a humectant as the carrier for the additives. Examples of flavoring additives commonly used in the tobacco industry are menthol, anethole, cinnamaldehyde, vanillin, ethyl vanillin, peppermint oil and spearmint oil. Other examples of tobacco flavoring additives may be found in a compilation published in World Tobacco 59, pages 89–91 (January 1978). The flavoring additives preferably included in the humectant carrier are those additives which are volatile. For the purposes of this invention, volatile flavoring additives are defined as those additives which readily distil at atmospheric pressure without appreciable decomposition or which are volatile with steam. In contrast to the volatility of the preferred additives, the sugars used in casing compositions are not distillable at atmospheric pressure nor are they volatile with steam.

The composition of the flavoring additive/humectant carrier system applied to the tobacco will depend on various factors including (a) the desired final humectant level in the treated tobacco, (b) the desired final concentration of flavoring additive or additives in the treated tobacco and (c) the solubility or miscibility of the flavoring additive(s) in the humectant carrier under the process conditions used. The normal use levels of humectants in tobacco products are sufficiently high so that no particular problems are encountered in achieving the desired concentration of flavoring additives. The World Tobacco reference mentioned above, for example, recommends maximum weight percentages (based on dry weight of tobacco) of 3.0, 10.0 and 6.0 percent of 1,3-butanediol, glycerol and propylene glycol, respectively. For certain flavoring additives and humectants which are in the solid state at ambient temperatures it may be necessary to heat the mixture when preparing and applying the additive/carrier system. Depending on the degree of volatility of the particular flavoring additive(s) being applied, the additive/carrier system may be heated to temperatures of 30° to 100° C. at the time of application to the tobacco in order to maintain a homogeneous, liquid system. It is obvious that two or more humectants may also be used in combination to prepare the flavoring additive/humectant carrier system. The incorporation of suitable emulsifiers may also be necessary with some systems. Regardless of the techniques used in preparing the flavoring additive/humectant carrier systems, it is essential that they be completely homogeneous under the application conditions employed so that the additive(s) and humectant(s) can be applied to the tobacco at consistently uniform levels.

When menthol is used as the flavoring additive, it is preferred that the polyhydric alcohol selected as the carrier be one that is capable of dissolving appreciable quantities of menthol. This is particularly true where the treated tobacco is to be used for manufacturing tobacco products containing relatively high levels of menthol. The use of higher menthol concentrations in the humectant carrier makes it possible to avoid excessive levels of humectant in such treated tobacco. Accordingly, it is preferred that menthol concentrations in the humectant carrier medium be at least 20 percent or, more preferred, at least 35 percent or, most preferred, at least 50 percent by weight based on the total weight of the menthol/carrier system. When propylene glycol, for example, is used as the carrier, it is possible to employ menthol concentrations of up to 80 percent by weight or more in the menthol/propylene glycol system.

The manner in which the flavoring additive/humectant carrier system is applied to the tobacco is a very important consideration if the additive is to be distributed uniformly throughout the tobacco. Since the humectants preferred for use with this invention are relatively high boiling, viscous liquids as compared to solvents such as ethanol and propanol which have traditionally been used as flavorant carriers, it is necessary to employ spray nozzles which are capable of accommodating the viscosities and relatively low flow rates involved. Spray nozzles which are effective for this purpose include the gas- or air-atomizing type nozzles which emit an aerosol spray that is very suitable. Such nozzles may generate the aerosol spray by mixing the compressed gas or air with the liquid medium either internally or externally to the nozzle from which the liquid medium emerges. Gas-atomizing spray nozzles are also amenable to use with heated flavoring additive/humectant carrier systems in that a heated gas may be used to effect atomization of the additives. Although other types of spray nozzles such as hydraulic pressure type nozzles will accommodate the liquid humectant/flavorant systems, such nozzles give less satisfactory results as far as uniform distribution of the additives throughout the tobacco mass is concerned.

Another important consideration is the nature of the moving tobacco stream as it moves through the treating zone. The tobacco stream should be sufficiently spread out or dispersed to expose as many tobacco particles as possible to the droplets of liquid emerging from the spray nozzles. The temperature of the tobacco at the time it is contacted with the spray should be such that appreciable loss of flavoring additives due to evaporation is avoided. This is particularly true when a heated flavoring additive/humectant carrier system is being applied to the tobacco. It is preferred that the tobacco be agitated as it moves through the treating zone to improve exposure of the individual particles of tobacco to the spray droplets. At least one spray nozzle and preferably two or more spray nozzles are located in the treating zone. The number of nozzles, their location and their orientation with respect to the moving stream of tobacco will be largely determined by the design of the apparatus being used and the tobacco flow rate capacity of the apparatus. These factors are appreciated by those skilled in the art and the particular arrangement that is most suitable can be determined with a minimum of experimentation. For example, apparatus involving a rotating cylinder of the type disclosed in U.S. Pat. Nos. 3,419,015 and 4,054,145 has been found to be effective in the practice of this invention provided that the specific teachings contained herein are observed. Vertically disposed treating chambers of the general type disclosed in U.S. Pat. No. 3,742,961 may also be used with modifications in accordance with the present teachings. Other apparatus designs may also be adapted for use with this invention.

The manner in which the flow rate of the liquid humectant/flavorant system to the treating zone is controlled with respect to the stream of tobacco moving through the zone is crucial to the application of uniform levels of humectant/flavorant additives to the tobacco being treated. Although the prior art recognizes the need to control carefully with respect to each other the flow rates of the liquid and tobacco streams, the demands placed on devices for controlling the process streams are considerably less stringent with relatively dilute alcoholic solutions of flavoring additives as compared with the humectant/flavorant systems used in the present invention. Since it is desirable to avoid excessive levels of humectants in the treated tobacco, the present invention must achieve uniform distribution of flavoring additives with relatively small quantities of humectants. It is preferred that the humectant/flavorant flow rate be regulated by a mass flow meter and associated control valve means because mass flow meters are capable of accurate measurement even at low flow rates. Mass flow meters are commercially available and one such meter is described, for example, in U.S. Pat. No. 4,109,524. Other types of flow meters such as those based on regenerative sonics, magnetic or turbine flow principles may also be used provided that humectant/flavorant flow rates are used which permit accurate measurements. The continuous weighing devices for measuring the quantity of tobacco being introduced into the treating zone are well known in the art and require no separate description here. It is, of course, necessary to provide such weighing devices with means for generating signals which indicate the tobacco feed rate at any given instant. The tobacco feed rate signals and the humectant/flavorant flow rate signals are transmitted to a ratio controller which compares the signals and regulates the control valve through which the humectant/flavorant stream is introduced into the treating zone. Both pneumatic and electronic ratio controllers are satisfactory for this purpose.

A better understanding of the present invention is provided by referring to the drawing which illustrates in block diagrammatic form a preferred embodiment.

Cut tobacco is continuously introduced into tobacco treating chamber 12 via continuous tobacco weighing conveyor 11 which is provided with means for transmitting data on tobacco feed rates to ratio controller 15. Supply tank 13 containing the humectant with a predetermined concentration of flavorant(s) therein is provided with sufficient air pressure from supply source 16 via pressure control valve 17 to assure adequate flow of the humectant/flavorant fluid through flow meter 14 and control valve 18 to the air-atomizing spray nozzles in the tobacco treating chamber 12. Flow meter 14 is provided with means for transmitting fluid flow rate data to ratio controller 15. Ratio controller 15 is adjusted to give the desired humectant/flavorant to tobacco flow ratio. This ratio is continuously regulated by control valve 18 which responds to signals from ratio controller 15. Air pressure supply 19 and pressure control valve 20 provide air pressure to the air-atomizing spray nozzles in treating chamber 12.

Using a tobacco treating arrangement similar to that depicted in the drawing, a flavorant mixture containing either menthol or coumarin was applied to cut cigarette filler tobacco. This treating arrangement employed a conventional rotating cylinder of the type disclosed in U.S. Pat. No. 3,419,015. The cylinder was approximately 2.4 meters in length and it was provided with six air-atomizing spray nozzles equally spaced along a 1.3 meter length of stainless steel pipe positioned within the cylinder parallel to but slightly above the longitudinal axis of the cylinder. The spray nozzles were oriented so that the spray was directed onto the tobacco as it was falling from the flights attached to the inside surface of the rotating cylinder. A Proctor & Schwartz continuous weighing conveyor was used to introduce a stream of cut tobacco into the rotating cylinder and a Model B-12 mass flow meter available from Micro Motion Incorporated of Boulder, Colo. was employed to measure the flow rate of the flavorant solution. The flavorant solution flow rate was controlled by a TY78S control valve obtained from Badger Meter, Inc., of Tulsa, Okla. and the ratio controller was a Model No. 57-Z pneumatic ratio controller supplied by Foxboro Instruments Company of Foxboro, Mass. The flavorant mixture was dissolved in the solvent medium to give the desired final flavorant concentration. Cut tobacco was introduced into the rotating cylinder at the rate of 5,900 kilograms per hour and the ratio controller was set to deliver the desired quantity of flavorant mixture per kilogram of tobacco. Air pressure in the head space of the flavorant supply tank was maintained at 3922 g/cm$^2$ (gauge) and the air pressure supplied to the air-atomizing spray nozzles in the cylinder was maintained at 844 g/cm$^2$ (gauge). Treated tobacco withdrawn from the rotating cylinder was collected in containers and allowed to stand at room temperature for 24 hours. Representative samples were randomly taken from the containers for flavorant analyses. The results are shown in Table 1 below.

For comparison purposes experimental data were also obtained for tobacco treated with alcoholic solutions of flavorants using an arrangement which was the same as that described above except that the rotating cylinder was provided with six hydraulic pressure type spray nozzles instead of the air-atomizing type spray nozzles and associated air pressure supply. Also, the flow meter used for measuring the flow rate of the alcoholic solution was a 2800 series magnetic flow meter supplied by Foxboro Instruments Company of Foxboro, Mass. The data for treatment of tobacco with alcoholic solutions of flavorants are also shown in Table 1 below.

TABLE 1

TREATMENT OF TOBACCO WITH FLAVORANTS

| Solvent Used for Flavorant Medium | Flavorant Being Monitored | Flavorant Concentration in Medium (% by Weight) | Grams of Flavorant Medium Applied per Kg. of Tobacco | Calculated Flavorant Level in Treated Tobacco (% by Wt.) | Measured Flavorant Level in Treated Tobacco: Samples Analyzed | Average Level (% by Weight) | Standard Deviation |
|---|---|---|---|---|---|---|---|
| Propylene Glycol | Menthol | 37.8 | 8.60[a] | 0.325 | 12 | 0.30 | 0.016 |
| Ethanol | Menthol | 16.8 | 19.37 | 0.325 | 12 | 0.31 | 0.030 |
| Propylene Glycol | Menthol | 37.8 | 8.60[a] | 0.325 | 16 | 0.29 | 0.019 |
| Ethanol | Menthol | 16.8 | 19.37 | 0.325 | 16 | 0.32 | 0.024 |
| Propylene Glycol | Coumarin | 0.67 | 4.48[b] | 0.0030 | 16 | 0.0035 | 0.00025 |
| Ethanol | Coumarin | 0.21 | 14.30 | 0.0030 | 16 | 0.0033 | 0.00054 |

[a]Flavorant medium was applied through Spray Set-Up 1/4J 13 303 stainless steel air-atomizing spray nozzles obtained from Spraying Systems Company of Wheaton, Illinois.

[b]Flavorant medium was applied through Spray Set-Up 1/4J 13A 303 stainless steel air-atomizing spray nozzles obtained from Spraying Systems Company of Wheaton, Illinois.

It is apparent from the data shown in Table 1 that the humectant-based flavorant media can be applied to tobacco at desired flavorant levels and that the uniformity of such flavorant levels is superior to that obtained with alcohol-based flavorant media. Although propylene glycol is preferred as both the humectant and as a carrier for the flavoring additives, other humectant/-flavorant combinations may be employed as described in the following examples.

EXAMPLE 1

A tobacco treating arrangement similar to that shown in the drawing is used to apply a solution of coumarin in glycerol to cut cigarette filler tobacco. A glycerol solution containing 0.70 percent by weight coumarin is sprayed onto a moving stream of cut tobacco through six air-atomizing spray nozzles at the rate of 4.30 grams of coumarin/glycerol solution per kilogram of tobacco. The treated tobacco emerging from the tobacco treating chamber contains approximately 0.0030 percent by weight coumarin uniformly distributed throughout the tobacco mass.

EXAMPLE 2

A tobacco treating arrangement similar to that shown in the drawing is used to apply a solution of vanillin in glycerol to cut pipe smoking tobacco. A glycerol solution containing 3.0 percent by weight vanillin is sprayed onto a moving stream of cut tobacco through six air-atomizing spray nozzles at the rate of 25 grams of vanillin/glycerol solution per kilogram of tobacco. The treated tobacco emerging from the tobacco treating chamber contains approximately 0.072 percent by weight vanillin uniformly distributed throughout the tobacco mass.

EXAMPLE 3

A tobacco treating arrangement similar to that shown in the drawing is used to apply a solution of menthol in diethylene glycol to cut cigarette filler tobacco. A diethylene glycol solution containing 58.3 percent by weight menthol is sprayed onto a moving stream of cut tobacco through six air-atomizing spray nozzles at the rate of 9.20 grams of menthol/diethylene glycol solution per kilogram of tobacco. The treated tobacco emerging from the tobacco treating chamber contains approximately 0.52 percent by weight menthol uniformly distributed throughout the tobacco mass.

EXAMPLE 4

A tobacco treating arrangement similar to that shown in the drawing is used to apply a solution of menthol in propylene glycol to cut cigarette filler tobacco. A propylene glycol solution containing 82 percent by weight menthol is sprayed onto a moving stream of cut tobacco through nine air-atomizing spray nozzles at the rate of 12.14 grams of menthol/propylene glycol solution per kilogram of tobacco. The treated tobacco emerging from the tobacco treating chamber contains approximately 0.97 percent by weight menthol uniformly distributed throughout the tobacco mass.

EXAMPLE 5

A tobacco treating arrangement similar to that shown in the drawing is used to apply a solution of ethyl vanillin in triethylene glycol to cut pipe smoking tobacco. A triethylene glycol solution containing 2.0 percent by weight ethyl vanillin is sprayed onto a moving stream of cut tobacco through six air-atomizing spray nozzles at the rate of 20 grams of ethyl vanillin/triethylene glycol solution per kilogram of tobacco. The treated tobacco emerging from the tobacco treating chamber contains approximately 0.038 percent by weight ethyl vanillin uniformly distributed throughout the tobacco mass.

EXAMPLE 6

A tobacco treating arrangement similar to that shown in the drawing is used to apply a solution of menthol in propylene glycol to cut cigarette filler tobacco. The tobacco treating chamber comprises a vertical tower having a rectangular cross section 61 cm. by 46 cm. and provided with nine adjustable baffles measuring about 48 cm. by 46 cm. hingedly attached to two opposing walls of the tower in alternating fashion vertically spaced approximately 23 cm. apart. The hingedly attached baffles are adjusted to slope downwardly toward the center of the tower at an angle of about 31° with respect to the side wall of the tower to which the respective baffles are attached. Except for the two uppermost baffles, each baffle is provided with a hole adjacent the hinged side of the baffle through which an air-atomizing type spray nozzle unit protrudes. A stream of cut cigarette filler tobacco approximately 46 cm. wide is introduced into the upper portion of the tower at a flow rate of 6,800 kilograms per hour. The gravity-induced downward flow of tobacco is momentarily interrupted by each baffle to promote mixing of the tobacco. As the tobacco falls downwardly through the vertical tower, a propylene glycol solution containing 36.5 percent by weight menthol is sprayed onto the tobacco through the seven spray nozzles at the rate of 6.67 grams per kilogram of tobacco. The treated tobacco emerging from the lower end of the tower contains approximately 0.24 percent by weight menthol uniformly distributed throughout the tobacco mass.

It is apparent from the above teachings that this invention provides a substantial improvement in the processing of tobacco that is to be used in the manufacture of smoking products. Considerable economic benefits are realized when at least a portion of the polyhydric alcohol humectant normally included in casing materials applied to tobacco strips is withheld for use as a carrier for a volatile flavoring additive that is continuously applied to a moving stream of the tobacco after it has been cut or shredded with the volatile flavoring additive/humectant carrier being applied at a controlled rate with respect to the moving stream of cut or shredded tobacco. Most importantly, the quality of smoking products prepared from tobacco processed in accordance with this invention is not adversely affected.

This invention can also be used for processing tobacco intended for non-smoking products. Thus, cut or comminuted tobacco used in the manufacture of snuff products can be treated with flavoring additives and humectants by employing the presently disclosed method.

While several embodiments of this invention have been described above, many other modifications can be made by those skilled in the art without departing from the spirit and scope of the appended claims.

What is claimed is:

1. A continuous process for treating cut, shredded or otherwise comminuted tobacco which comprises subjecting a moving stream of cut, shredded or otherwise comminuted tobacco to a liquid spray comprising a volatile flavoring additive in a carrier medium containing a polyhydric alcohol as the principal component of said carrier medium, the quantity of said liquid spray being controlled with respect to the feed rate of said stream of tobacco by flow control means associated with a flow measuring device based on mass flow, regenerative sonics, magnetic flow or turbine flow principles which measures the flow rate of said carrier medium and the volatile flavoring additive contained therein.

2. The process of claim 1 wherein said liquid spray is generated by gas-atomizing spray nozzle means.

3. The process of claim 1 or 2 wherein the stream of tobacco is also subjected to agitation means as it is being treated with said liquid spray.

4. The process of claim 3 wherein said volatile flavoring additive comprises menthol and said polyhydric alcohol comprises propylene glycol.

5. A continuous process for treating a moving stream of cut, shredded or otherwise comminuted tobacco with a volatile flavoring additive in combination with a carrier medium for said additive comprising a polyhydric alcohol humectant as the principal component of said carrier medium, said continuous process comprising (a) directing said stream of cut, shredded or otherwise comminuted tobacco into a treating zone at a measured flow rate, (b) introducing into said treating zone the volatile flavoring additive/carrier medium combination in the form of a gas-atomized spray, (c) measuring the flow rate of the volatile flavoring additive/carrier medium combination introduced into said treating zone by a flow measuring device based on mass flow, regenerative sonics, magnetic flow or turbine flow principles, (d) controlling the flow rate of the volatile flavoring additive/carrier medium combination introduced into said treating zone with respect to the flow rate of the tobacco stream entering said treating zone, and (e) withdrawing a stream of treated tobacco from said treating zone.

6. The process of claim 5 wherein said tobacco is agitated as it moves through said treating zone.

7. The process of claim 5 or 6 wherein said gas-atomized spray is generated by a plurality of gas-atomizing spray nozzles.

8. The process of claim 7 wherein said volatile flavoring additive comprises menthol and said polyhydric alcohol comprises propylene glycol.

9. The process of claim 5 or 6 wherein said volatile flavoring additive/carrier medium combination is heated at temperatures up to 100° C. at the time said combination is introduced into said treating zone.

10. A continuous process for applying menthol to a moving stream of cut tobacco which comprises (a) providing a liquid medium containing menthol in combination with a polyhydric alcohol wherein the menthol concentration in said medium is at least 20 percent by weight, (b) introducing a stream of cut tobacco at a measured flow rate into a treatment zone that is provided with tobacco agitation means and spray nozzle means positioned to direct a spray of said liquid medium onto the tobacco, (c) continuously supplying a quantity of the menthol-containing liquid medium to said spray nozzle means in the treatment zone, (d) regulating the flow rate of said menthol-containing liquid medium supplied to said spray nozzle means with respect to the measured flow rate of the cut tobacco introduced into said treatment zone to give a predetermined ratio of menthol to tobacco and (e) withdrawing from the treatment zone a stream of cut tobacco having a predetermined quantity of menthol applied thereto.

11. The process of claim 10 wherein the quantity of said menthol-containing liquid medium supplied to said spray nozzle means is measured by a mass flow meter.

12. The process of claim 10 wherein said liquid spray is generated by gas-atomizing spray nozzle means and said polyhydric alcohol comprises propylene glycol.

13. The process of claim 12 wherein the concentration of menthol in said liquid medium is at least 35 percent by weight.

14. The process of claim 12 wherein the concentration of menthol in said liquid medium is at least 50 percent by weight.

15. In a continuous process for preparing tobacco for the manufacture of smoking products therefrom which includes the steps of (a) treating tobacco strips with a casing mixture that contains a polyhydric alcohol humectant, (b) cutting or shredding the cased tobacco strips and (c) applying a volatile flavoring additive to a moving stream of the cut or shredded tobacco, the improvement which comprises withholding at least a portion of the polyhydric alcohol humectant from the casing mixture for use as a carrier medium for the volatile flavoring additive and continuously applying the volatile flavoring additive in said portion of the polyhydric alcohol humectant to the moving stream of cut or shredded tobacco at a controlled rate with respect to the flow rate of the moving stream of cut or shredded tobacco.

16. The improvement of claim 15 wherein said volatile flavoring additive in said portion of the polyhydric alcohol humectant is applied to the moving stream of cut or shredded tobacco as an aerosol spray generated by gas-atomizing spray nozzle means.

17. The improvement of claim 16 wherein the moving stream of cut or shredded tobacco is agitated as said aerosol spray is applied thereto.

18. The improvement of claim 15 wherein the rate at which said volatile flavoring additive in said carrier medium is applied to the moving stream of cut or shredded tobacco is controlled by flow control means associated with a flow measuring device which measures the flow rate of the volatile flavoring additive in said carrier medium applied to the moving stream of cut or shredded tobacco.

19. The improvement of claim 18 wherein the flow measuring device is based on mass flow, regenerative sonics, magnetic flow or turbine flow principles.

20. The improvement of claim 15, 16, 17, 18 or 19 wherein said volatile flavoring additive comprises menthol and the polyhydric alcohol comprises propylene glycol.

21. The improvement of claim 20 wherein the concentration of menthol in the carrier medium is at least 20 percent by weight.

22. The improvement of claim 20 wherein the concentration of menthol in the carrier medium is at least 25 percent by weight.

23. The improvement of claim 20 wherein the concentration of menthol in the carrier medium is at least 50 percent by weight.

24. A continuous process for applying volatile flavoring additives to a moving stream of cut tobacco which comprises (a) providing a liquid medium containing at least two volatile flavoring additives and a polyhydric alcohol with said polyhydric alcohol constituting at least 50 percent by weight of said liquid medium, (b) moving a stream of cut tobacco at a measured flow rate through a treatment zone that is provided with tobacco agitation means and a plurality of spray nozzles positioned to direct a spray pattern of liquid onto the stream of cut tobacco, (c) continuously supplying a quantity of said liquid medium to said spray nozzles for application to the cut tobacco, (d) regulating the flow rate of said liquid medium supplied to said spray nozzles with respect to the measured flow rate of said stream of cut tobacco moving through the treatment zone and (e) recovering a stream of treated tobacco from said treatment zone, said treated tobacco having a predetermined quantity of said volatile flavoring additives applied thereto.

25. The process of claim 24 wherein said polyhydric alcohol is selected from the group consisting of propylene glycol, dipropylene glycol, trimethylene glycol, diethylene glycol, triethylene glycol, glycerol, α-methylglycerol, 1,2-butanediol, 1,3-butanediol, 1,4-butanediol and 2,3-butanediol.

26. The process of claim 24 or 25 wherein said liquid medium is applied to the cut tobacco in the form of a gas-atomized aerosol spray.

27. The process of claim 26 wherein said volatile flavoring additives include menthol and constitute at least 20 percent by weight of said liquid medium.

* * * * *

UNITED STATES PATENT AND TRADEMARK OFFICE

CERTIFICATE OF CORRECTION

PATENT NO. : 4,449,541

DATED : May 22, 1984

INVENTOR(S) : Charles D. Mays, Max A. Wagoner, Daniel G. Williard

It is certified that error appears in the above-identified patent and that said Letters Patent are hereby corrected as shown below:

In the ABSTRACT "[by gas-atomizing spray nozzle means]" should be deleted.

Column 1, line 39, "import" should read -- improve --.

Column 1, line 58, "," after sequence should be deleted.

Claim 22, line 2, "25" should read -- 35 --.

Signed and Sealed this

*Second* Day of *October 1984*

[SEAL]

*Attest:*

GERALD J. MOSSINGHOFF

*Attesting Officer*

*Commissioner of Patents and Trademarks*